US011415945B2

(12) United States Patent
Kadmiri

(10) Patent No.: US 11,415,945 B2
(45) **Date of Patent: *Aug. 16, 2022**

(54) MUSICAL WATCH CASE

(71) Applicant: Montres Breguet S.A., L'Abbaye (CH)

(72) Inventor: Younes Kadmiri, Morre (FR)

(73) Assignee: Montres Breguet S.A., L'Abbaye (CH)

( * ) Notice: Subject to any disclaimer, the term of this patent is extended or adjusted under 35 U.S.C. 154(b) by 732 days.

This patent is subject to a terminal disclaimer.

(21) Appl. No.: 16/286,655

(22) Filed: Feb. 27, 2019

(65) Prior Publication Data

US 2019/0271949 A1 Sep. 5, 2019

(30) Foreign Application Priority Data

Mar. 5, 2018 (EP) ..... 18160023

(51) Int. Cl.
*G04B 37/00* (2006.01)
*G04B 37/08* (2006.01)
(Continued)

(52) U.S. Cl.
CPC ..... *G04B 37/0075* (2013.01); *G04B 23/028* (2013.01); *G04B 37/08* (2013.01); *G04B 37/22* (2013.01)

(58) Field of Classification Search
CPC .... G04B 37/22; G04B 37/08; G04B 37/0075; G04B 23/028; G04B 39/00; G04B 23/005; G04B 21/00; G04B 21/08; G04B 19/283
(Continued)

(56) References Cited

U.S. PATENT DOCUMENTS 4,258,432 A * 3/1981 Zafferri ..... G04C 21/02 368/250
4,271,498 A * 6/1981 Zafferri ..... G04B 39/00 368/250
(Continued)

FOREIGN PATENT DOCUMENTS

CH 712 216 A2 9/2017
CN 2080683 U 7/1991
(Continued)

OTHER PUBLICATIONS

Combined Chinese Office Action and Search Report dated Aug. 5, 2020 in Chinese Application 201910160687.8 (with English Translation of Category of Cited Documents), 7 pages.
(Continued)

*Primary Examiner* — Edwin A. Leon
(74) *Attorney, Agent, or Firm* — Oblon, McClelland, Maier & Neustadt, L.L.P.

(57) ABSTRACT

A musical watch case including a case middle with surfaces receiving and supporting a cover with a bezel, or a case back, and a casing ring, the case including at least one gong fixed to the case middle with a resonant part distinct from the walls of the case middle, which supports the cover via lugs included in the bezel or the case middle and which are arranged to allow vibration of the cover assembly at frequencies from 4 kHz to 6 kHz, these distinct and distant lugs forming, with at least one gasket, the only direct contacts between the bezel and the case middle, between which each lug includes a thin, elastic, median strip, more flexible than its solid distal end, and of smaller thickness than the smallest cross-section of these gongs.

25 Claims, 4 Drawing Sheets

(51) Int. Cl.
*G04B 37/22* (2006.01)
*G04B 23/02* (2006.01)

(58) Field of Classification Search
USPC ..... 368/294
See application file for complete search history.

(56) References Cited

U.S. PATENT DOCUMENTS

| | | | | |
|---|---|---|---|---|
| 7,995,776 | B2 | 8/2011 | Greubel et al. | |
| 2013/0176832 | A1 | 7/2013 | Kawashima | |
| 2016/0098013 | A1 | 4/2016 | Kadmiri et al. | |
| 2019/0271950 | A1* | 9/2019 | Kadmiri ..... | G04B 37/22 |

FOREIGN PATENT DOCUMENTS

| | | | |
|---|---|---|---|
| CN | 101164022 | A | 4/2008 |
| CN | 102692867 | A | 9/2012 |
| CN | 105093899 | A | 11/2015 |
| CN | 105122150 | A | 12/2015 |
| CN | 105127596 | A | 12/2015 |
| CN | 105277184 | A | 1/2016 |
| EP | 1 708 050 | A1 | 10/2006 |
| EP | 3 002 639 | A1 | 4/2016 |
| JP | 2007-101803 | A | 4/2007 |
| JP | 2016-70939 | A | 5/2016 |

OTHER PUBLICATIONS

Combined Chinese Office Action and Search Report dated Aug. 5, 2020 in Chinese Application 201910161255.9 (with English Translation of Category of Cited Documents), 7 pages.

European Search Report dated Sep. 20, 2018 in European Application 18160023.0, filed on Mar. 5, 2018 ( with English translation of categories of cited documents).

* cited by examiner

MUSICAL WATCH CASE

CROSS-REFERENCE TO RELATED APPLICATION

This application claims priority to European Patent Application No. 18160023.0 filed on Mar. 5, 2018, the entire disclosure of which is hereby incorporated herein by reference.

FIELD OF THE INVENTION

The invention concerns a musical watch case comprising at least one cover assembly which includes on the one hand a bezel, and on the other at least one crystal or case back, a casing ring, a case middle which has a first surface for receiving and supporting said cover assembly and a median surface for receiving and supporting said casing ring, said case including at least one gong integral with said case middle and including a resonant part distinct from the walls of said case middle.

The invention also concerns a musical watch comprising a striking mechanism and/or an alarm mechanism and/or a music box mechanism, and such a case.

The invention concerns the field of musical watches comprising a striking and/or alarm and/or music box mechanism.

BACKGROUND OF THE INVENTION

Good sound emission is always a difficult problem to overcome for a musical watch, since the radiating members must not get in the way of the watch user, or impair the sealing of the watch, and sound damping must be as low as possible in order to radiate the vibration of the gongs, disc-gongs, combs, bells or suchlike audibly to the user, with a sound that is not impaired by unwanted vibrations generated by other constituent parts of the watch, such as the striking work or music-playing activation mechanism and/or the striking work or music-playing regulating mechanism and/or the timepiece movement or otherwise.

Swiss Patent No CH712216A2 in the name of MONTRES BREGUET discloses a striking or musical timepiece with a resonant bezel. This musical timepiece includes a gong fixed to a structure or to a resonator of a case, the resonator being rigidly assembled to the structure around a chamber, by lugs allowing vibration of the resonator within a determined frequency range, the chamber enclosing a sealing element forming with the lugs the only mechanical connection between the structure and the resonator component and including at least one gasket in contact with the structure and the resonator, with a hardness of less than 20 Shore A, for minimum damping of the vibration of the resonator. In the application to a watch, the watch case includes a structure and a resonator which are rigidly assembled around a chamber enclosing a sealing element, the structure or the resonator includes a groove receiving a gasket, and the structure or the resonator or the sealing element includes a stiff projecting relief portion compressing a gasket in the groove.

European Patent No EP3002639A1 in the name of MONTRES BREGUET discloses a musical watch case with improved acoustic performance, with a bezel that directly carries a gong or forms a gong. This bezel includes a toroid portion receiving a watch crystal, and a thin lug perpendicular to the plane of the toroid portion comprising means of attachment to a structure. The case comprises a case middle and carries such a bezel resting indirectly on a main surface of the case middle via a first O ring seal; the case middle and the bezel are fixedly held in a position in which, in the free state of the bezel in the absence of pressure, the bezel is separated from this main surface by a value corresponding to a predetermined, non-zero clearance.

SUMMARY OF THE INVENTION

The invention proposes to ensure the best possible acoustic radiation for a resonant member such as a gong or similar, fixed, in particular, to the middle part of the watch case.

To this end, the invention concerns a musical watch case according to claim 1.

The invention also concerns a musical watch comprising a striking mechanism and/or an alarm mechanism and/or a music box mechanism, and such a case.

BRIEF DESCRIPTION OF THE DRAWINGS

Other features and advantages of the invention will appear from reading the following detailed description, with reference to the annexed drawings, in which:

in FIG. 1 with an external chamber partially closed by an annular wall, into which external chamber axially extend bezel lugs, fixed to the lowest part of the case middle, which supports, on its inner side, a casing ring via a radial silent-block gasket;

in FIG. 2 with an inner chamber into which axially extend bezel lugs, fixed to the case middle, which supports, on its inner side, a casing ring via a radial silent-block gasket;

FIG. 3 is a detail of a configuration wherein the case middle supports a casing ring via an axial silent-block gasket;

FIG. 4 is a detail of a configuration wherein the case middle supports a casing ring via a radial silent-block gasket and an axial silent-block gasket;

in FIG. 5 with bezel lugs extending axially outside an external chamber, fixed to the lowest part of the case middle, which supports, on its inner side, a casing ring via a radial silent-block gasket;

in FIG. 6 with an external chamber partially closed by an annular wall, into which external chamber extend obliquely bezel lugs, fixed to the lowest part of the case middle, which supports, on its inner side, a casing ring via a radial silent-block gasket;

in FIG. 7 with bezel lugs extending radially outside the case middle, which carries, on its inner side, a casing ring via a radial silent-block gasket;

FIG. 8 is a detail of a configuration wherein a conventional case middle supports a casing ring via an axial silent-block gasket;

FIG. 9 is a detail of another configuration wherein a conventional case middle supports a casing ring via a radial silent-block gasket and an axial silent-block gasket formed by a flat gasket of substantially rectangular cross-section;

FIG. 10 is another variant with bezel lugs extending radially, laterally supported? outside the case middle, which supports, on its inner side, a casing ring via a radial silent-block gasket;

DETAILED DESCRIPTION OF PREFERRED EMBODIMENTS

Figure 1:
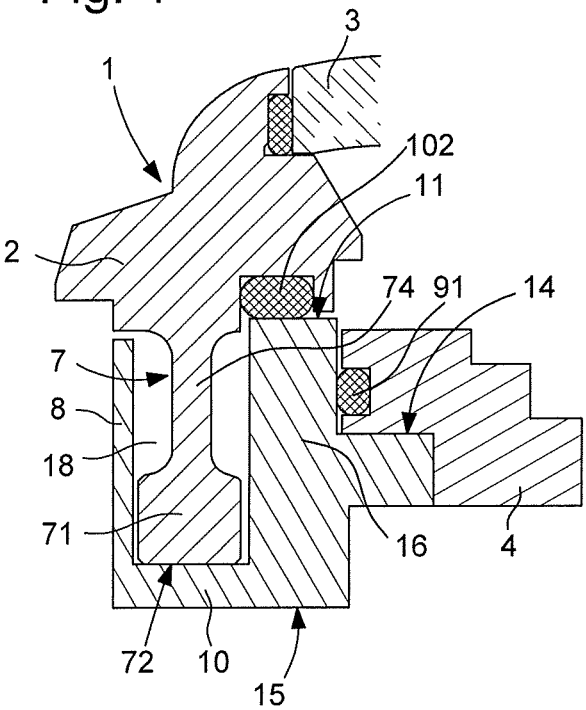
FIGS. 1 to 10 represent schematic cross-sectional views of different variants of the invention.
Figure 2:
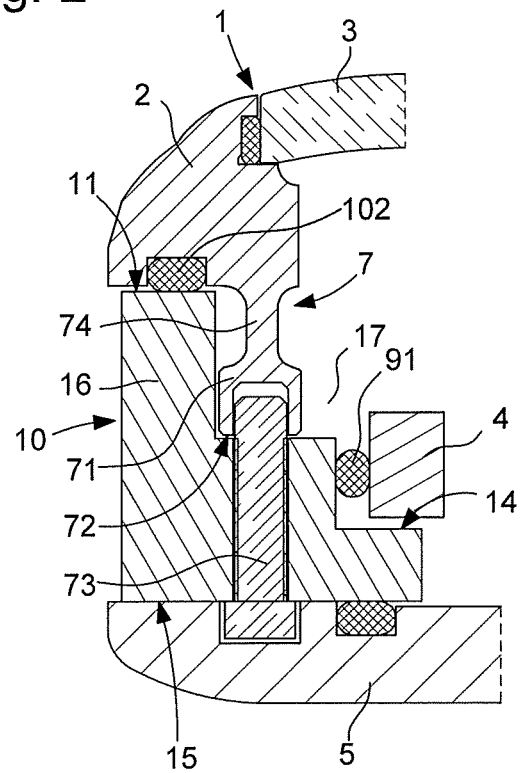
Figure 3:
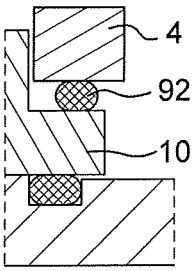
Figure 4:
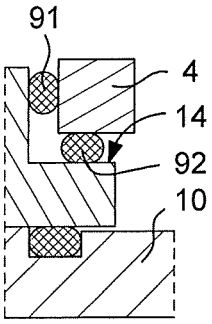
Figure 5:
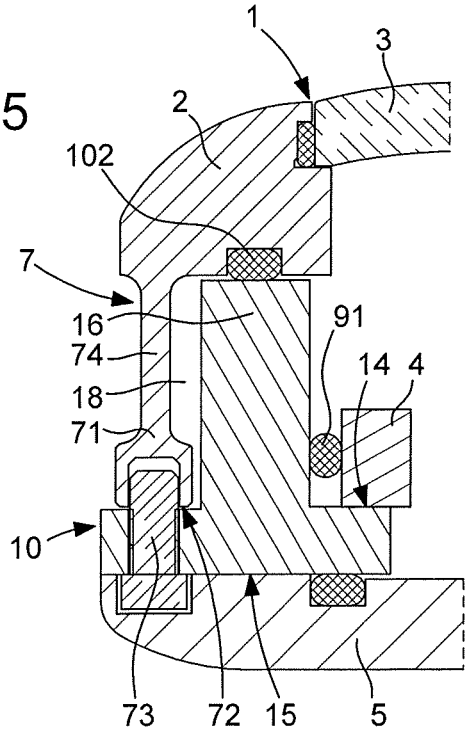
Figure 6:
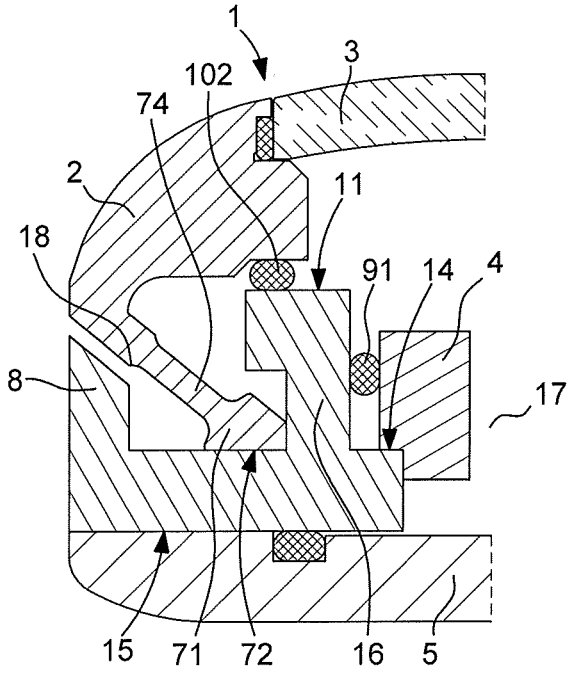
Figure 7:
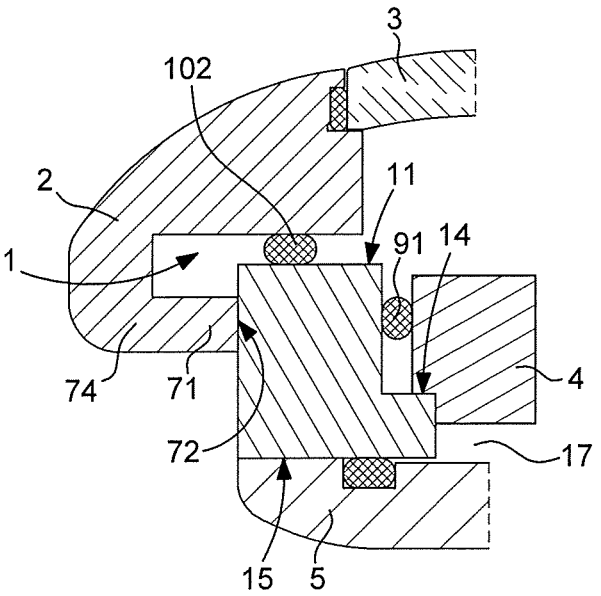
Figure 8:
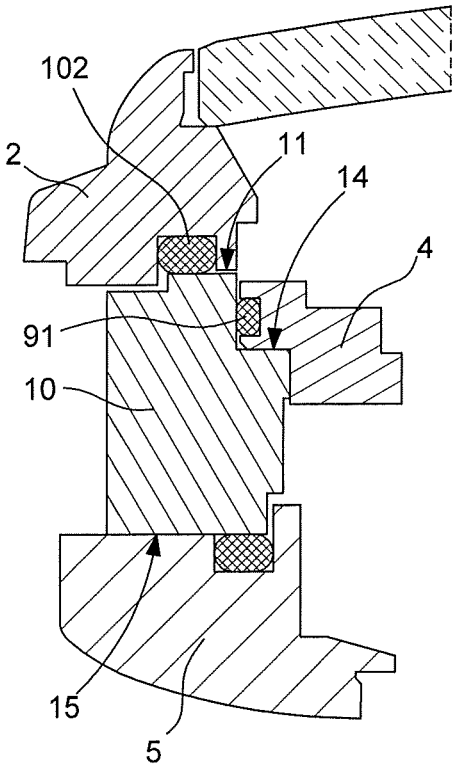
Figure 9:
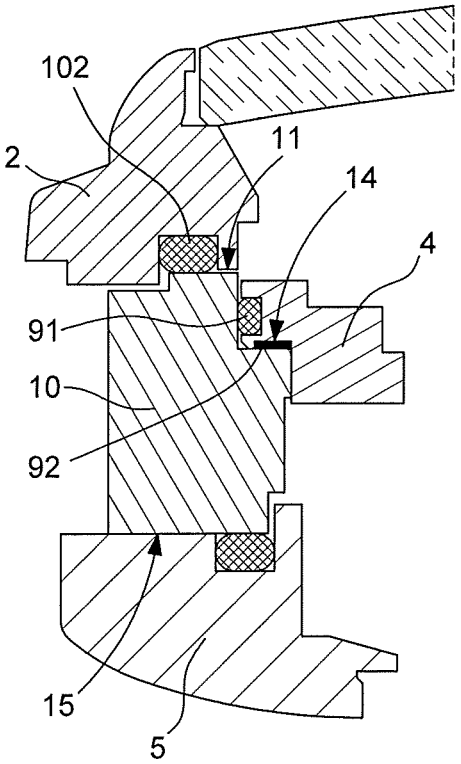
Figure 10:
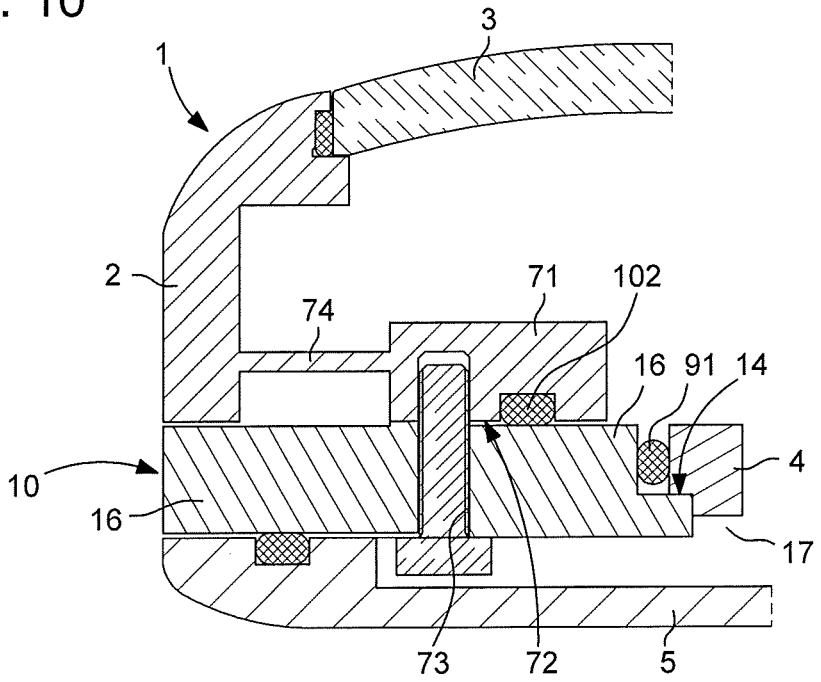
Figure 11:
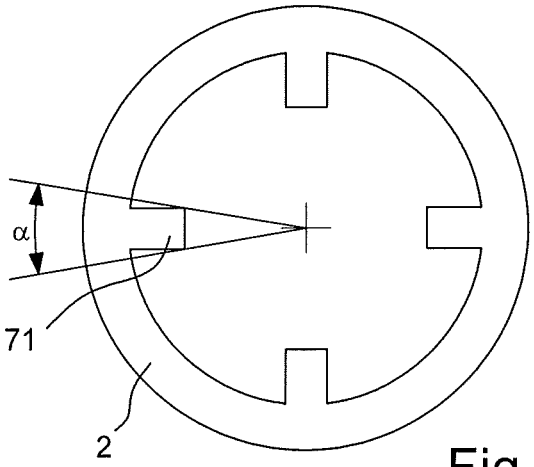
FIG. 11 is a top view of the bezel of FIG. 10 comprising four straight radial lugs, each extending over an angular sector with a central angle less than 20°.
Figure 12:
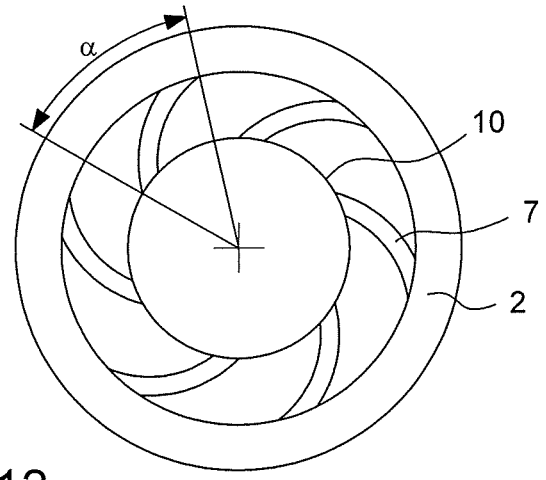
FIG. 12 is a top view of another bezel comprising six lugs arranged in a spiral, each extending over an angular sector with a central angle less than 45°.
Figure 13:
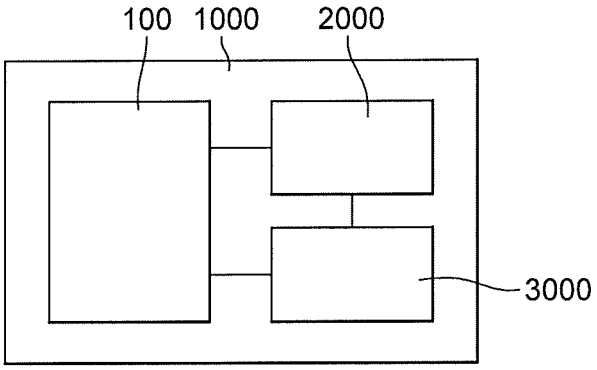
FIG. 13 is a block diagram showing a musical watch comprising a striking mechanism and an alarm mechanism, and comprising a case according to the invention.

The invention concerns a musical watch case 100 including a least one cover assembly 1. This cover assembly 1 includes, on the one hand a bezel 2, and on the other at least one crystal 3 or case back 5.

It is understood that case 100 may include an upper cover assembly 1 with a bezel 2 and a crystal 3, as illustrated by all the Figures, or may have a lower cover assembly 1 with a bezel 2 and a case back 5, or both an upper cover assembly 1 with a bezel 2 and a crystal 3, and a lower cover assembly 1 with a bezel 2 and a case back 5.

A 'musical watch' means a watch that includes a striking mechanism and/or an alarm mechanism and/or a music box mechanism.

Case 100 also includes a casing ring 4, arranged to carry a movement and/or a mechanism, and a case middle 10.

This case middle 10 has a first surface 11 for receiving and supporting cover assembly 1, and a median surface 14 for receiving and supporting casing ring 4.

This case middle 10, either forms a bottom of case 100, or has a second surface 15 for receiving and supporting a lower cover assembly including a bezel 2 and a back cover 5, or for directly receiving a back cover 5. When cover assembly 1 which rests on first surface 11 includes a bezel 2 and a case back 5, second surface 15 may naturally be adapted to receive a crystal 3, or another cover assembly 1 including a bezel 2 and a crystal 3.

More particularly, case 100 includes a back cover 5 which is transparent.

Case 100 includes at least one resonant member, particularly a gong 6 integral with case middle 10, i.e. added and secured to case middle 10, or in one-piece with case middle 10, and which includes a resonant part which is distinct from the walls of case middle 10. The resonant member may take different forms from a gong without changing the essence of the invention. A 'gong' 6 therefore means any resonant member usually used in horology: a gong, disc-gong, comb, bell or suchlike.

Case middle 10 supports cover assembly 1 via at least one lug 7, comprised in bezel 2 or case middle 10, and which is arranged to allow vibration and radiation of cover assembly 1 at frequencies comprised between 4 kHz and 6 kHz.

Each lug 7 extends in an angular sector with a central angle $\alpha$ less than 45° relative to the centre of case 100 and is distinct from any other said lug 7 and has no contact with any other lug 7.

In a variant, this lug 7 or these lugs 7 form the only direct contacts between bezel 2 and case middle 10.

In another variant, as seen in the Figures, this lug 7 or these lugs 7 form, with at least one sealing gasket 102, the only direct contacts between bezel 2 and case middle 10.

More particularly, each lug 7 extends in an angular sector with a central angle $\alpha$ less than 45° relative to the centre of case 100.

More particularly, this at least one lug 7 includes, at a solid distal end 71, at least one support surface 72 which is arranged to cooperate in abutment with case middle 10 or respectively bezel 2, and securing means 73 which are arranged to rigidly secure this lug 7 by at least one support surface 71 resting or compressed on case middle 10 or respectively bezel 2.

More particularly still, at least one lug 7, and advantageously each said lug 7, includes, between case middle 10 and bezel 2, a thin elastic median strip 74, which is more flexible than solid distal end 71, and whose thickness is, more particularly, smaller than the smallest thickness of case middle 10 and is smaller than the smallest thickness of bezel 2.

According to the invention, at least one lug 7, or each said lug 7, includes, between case middle 10 and bezel 2, a thin elastic median strip 74, which is more flexible than solid distal end 71, and whose thickness is, more particularly, smaller than the smallest cross-section of each gong 6.

In a particular embodiment, case middle 10 includes at least one substantially annular, peripheral wall 16, which defines an inner chamber 17 extending around casing ring 4. More particularly, case 100 includes lugs 7 inside this inner chamber 17. More particularly still, all of lugs 7 of case 100 are inside inner chamber 17.

In another variant of the invention, case middle 10 includes at least one substantially annular, peripheral wall 16 defining an inner chamber 17 extending around casing ring 4, arranged to support a timepiece movement and/or a timepiece mechanism, and case 100 includes lugs 7 outside case middle 10, towards the edge of case 100, on the opposite side to inner chamber 17 relative to case middle 10. More particularly still, all of lugs 7 of case 100 are outside case middle 10, towards the edge of case 100, on the opposite side to inner chamber 17 relative to case middle 10.

According to a particular embodiment of the invention, the case includes a plurality of such lugs 7 each including, between case middle 10 and bezel 2, a thin elastic, substantially rectilinear median strip 74, and the directions of all of thin, elastic, substantially rectilinear strips 74 have the same inclination relative to a same central reference axis.

According to a particular embodiment of the invention, all of thin, elastic, substantially rectilinear median strips 74 are arranged on a same surface of revolution about the same central reference axis.

In a particular variant, this surface of revolution is a cone.

In a particular variant, this surface of revolution is a cylinder.

In yet another variant, all of thin, elastic, substantially rectilinear median strips 74 are arranged in a same plane or parallel to a same plane.

According to a particular feature of the invention, case middle 10 includes, around a substantially annular, peripheral wall 16 defining an inner chamber 17 extending around casing ring 4, and around all of lugs 7 comprised in case 100, a resonator ring 8, which is added to case middle 10 or which forms a lip of case middle 10. This resonator ring 8 is distant at all points from bezel 2 and lugs 7, and forms with peripheral wall 16 an outer radiating cavity 18. More particularly, resonator ring 8 is of smaller thickness than that of each lug 7 and is made of an alloy of gold and/or of platinum and/or of titanium.

In a particular advantageous manner, at least one of the metal constituent parts of case 100, and more particularly all the metal constituent parts of case 100, with the exception of the crystals and sealing gaskets, is made from a material allowing a critical radiation frequency lower than or equal to that obtained with an embodiment made from gold alloy or from gold. More particularly, case middle 10, bezel 2, and back cover 5 when case 100 has a metal case back 5, are made from the same alloy. More particularly still, this alloy is a titanium alloy, well suited to the mechanical stresses and to the sealing stresses usually seen at at least 5 bar, and whose radiating power is greater than that of gold; this choice allowing a natural frequency to be obtained in the desired range of 4 kHz to 6 kHz. In a particular variant, this alloy is Grade 5 titanium, containing 90° of titanium, 6% of aluminium, and 4% of vanadium; in another variant this alloy is a precious alloy of titanium, and particularly of titanium and gold, according to one of Patent Applications Nos PCT/EP2015/080211 and PCT/EP2015/080270 in the name of Montres Breguet SA. More particularly, a graded alloy is chosen.

In particular, crystal 3 is made of sapphire, also to ensure proper radiation. Likewise, when case back 5 of case 100 includes a crystal, the latter is preferably made of sapphire.

According to a particular feature of the invention, case middle 10 has at least one substantially annular, peripheral wall 16 defining an inner wall 17 extending around casing ring 4, and case 100 includes, at a distance from median support surface 14 for casing ring 4 on case middle 10, at least a first substantially ring-shaped silent-block gasket 91, which is arranged to limit the transfer of vibrations between an operating musical movement or striking work and the external parts of case 100, and to decrease unwanted noise without hampering the vibration of each gong 6.

According to another particular feature of the invention, case middle 10 includes at least one substantially annular, peripheral wall 16 defining an inner chamber 17 extending around casing ring 4, and case 100 includes, on median support surface 14 for casing ring 4 on case middle 10, and between casing ring 4 and case middle 10, at least a second substantially ring-shaped silent-block gasket 92, which is arranged to limit the transfer of vibrations between an operating musical movement or striking work and the external parts of case 100, and to decrease unwanted noise without hampering the vibration of each gong 6.

Figure 14:
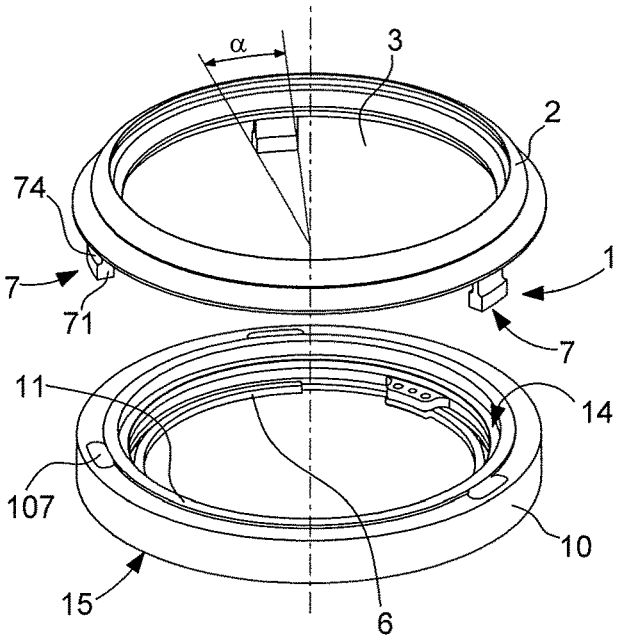
FIG. 14 represents a schematic and exploded perspective view of a part of a case according to the invention, made of titanium alloy, comprising a case middle on which is fixed a gong, and which includes cavities at the bottom of which are fixed the ends of three lugs comprised in a bezel of a cover assembly, which also includes a crystal.
Figure 15:
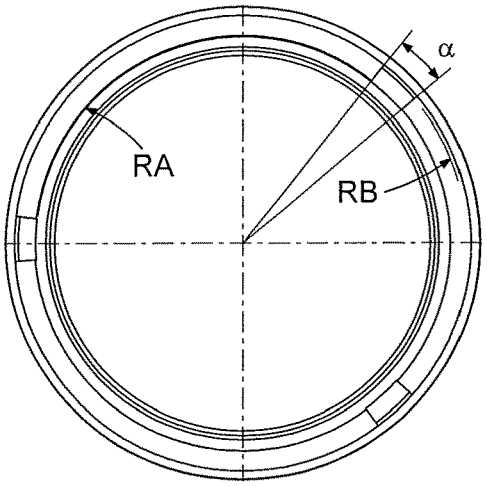
FIG. 15 is a plan view of the case of FIG. 14.

FIGS. 14 and 15 illustrate a particular embodiment of a case 100 according to the invention, comprising a case middle 10 on which is fixed a gong 6, and which includes cavities 107 at the bottom of which are fixed the solid ends 71 of lugs 7 comprised in a bezel 2 of a cover assembly 1, which also includes a crystal 3. More particularly, this case middle 10 is made of titanium alloy, such as Grade 5 titanium or similar, and bezel 2, which includes three lugs 7 at substantially 120° from each other, which each extend with a central angle $\alpha$ of 11.5°. Radius RA is 35.455 mm and radius RB is 38.55 mm. The mass of cover assembly 1 (bezel and crystal) is around 10 g.

Figure 16:
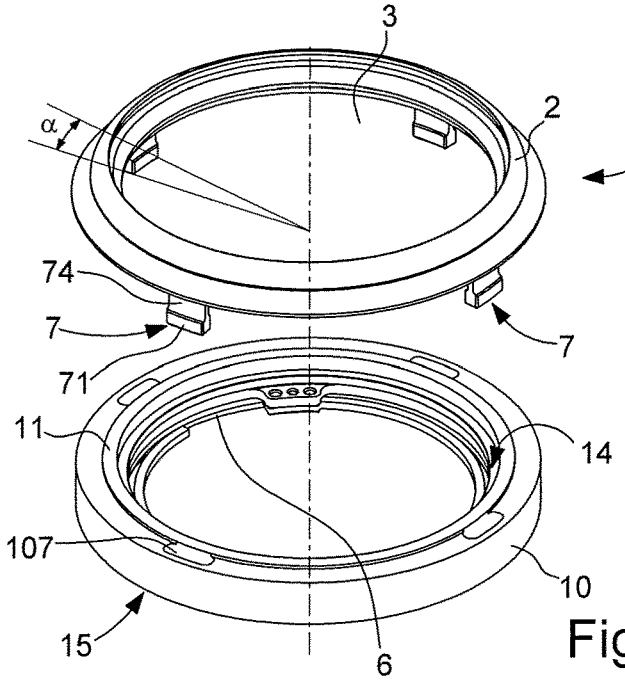
FIGS. 16 and 17 illustrate, in a similar manner to FIGS. 14 and 15, a case made of 18 carat gold alloy, comprising four lugs.
Figure 17:
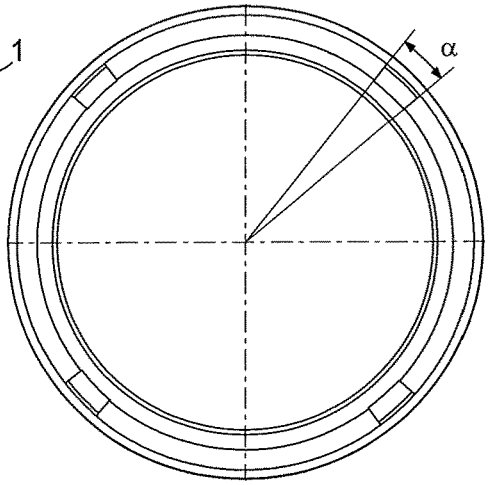

In another variant, as seen in FIGS. 16 and 17, case middle 10 is made from graded gold alloy, and the bezel includes four lugs 7, at substantially 90° from each other, which each extend with a central angle $\alpha$ of 11.5°. The mass of cover assembly 1 (bezel and crystal) is around 19 g.

Figure 18:
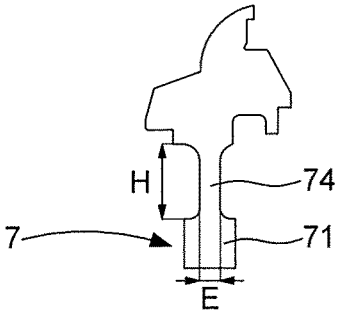
FIG. 18 is a radial cross-sectional view of a bezel lug of FIG. 14.

FIG. 18 represents the cross-section of lug 7 used for the embodiments of FIGS. 14 to 17. Thin median strip 74 has a thickness E of 0.60 mm, and a height H of 2.18 mm.

According to a particular feature of the invention, case middle 10 is made in one piece with at least one gong 6.

According to a particular feature of the invention, case middle 10 is made from an alloy of gold and/or platinum and/or titanium.

In a particular variant, case 100 includes at least one gong 6 fixed to a cover assembly 1 comprised therein, either in one piece with a bezel 2, or secured to a lug 7, or in one piece with a lug 7.

In another alternative, case middle 10 supports cover assembly 1 by at least one lug 7 comprised in bezel 2 or case middle 10. The orientation of lug 7 or lugs 7 is unimportant, the minimum median cross-section of these lugs is smaller than the end cross-sections of said same lugs, and this median cross-section is larger than the smallest cross-section of the gongs or, in a particular variant, is larger than the largest cross-section of the gongs.

The invention also concerns a musical watch 1000 comprising a striking mechanism 2000 and/or an alarm mechanism 3000 and/or a music box mechanism and including such a case 100.

The invention claimed is:

1. A musical watch case comprising:

at least one cover assembly, which includes a bezel, and at least one crystal or one case back, a casing ring, a case middle which has a first surface for receiving and supporting said cover assembly and a median surface for receiving and supporting said casing ring, said case including at least one gong integral with said case middle and including a resonant part distinct from the walls of said case middle, wherein said case middle supports said cover assembly via at least one lug comprised in said bezel or said case middle and which is arranged to allow said cover assembly to vibrate and radiate at frequencies comprised between 4 kHz and 6 kHz, each said lug being distinct from every other said lug and having no contact with any other said lug, wherein said at least one lug includes, at a solid distal end, at least one support surface arranged to cooperate in abutment with said case middle or respectively said bezel, and securing means arranged to rigidly secure said at least one lug via its said at least one support surface resting or compressed on said case middle or respectively said bezel, and wherein said each said lug includes, between said case middle and said bezel, a thin, elastic median strip, more flexible than said solid distal end, and whose thickness is smaller than the smallest cross-section of each said gong.

2. The case according to claim 1, wherein said lugs form, with at least one sealing gasket, the only direct contacts between said bezel and said case middle.

3. The case according to claim 1, wherein said lugs form the only direct contacts between said bezel and said case middle.

4. The case according to claim 1, wherein each lug extends in an angular sector with a central angle less than 45' relative to a center of said case.

5. The case according to claim 1, wherein said case middle forms a back cover of said case, or has a second surface for receiving and supporting a back cover when said cover assembly does not include a back cover.

6. The case according to claim 1, wherein said case middle or said cover assembly supports or includes a transparent back cover.

7. The case according to claim 1, wherein said thin, elastic, median strip has a thickness that is smaller than the smallest thickness of said case middle and is smaller than the smallest thickness of said bezel.

8. The case according to claim 1, wherein said case middle includes at least one substantially annular, peripheral wall defining an inner chamber extending around said casing ring, and wherein said case includes said lugs inside said inner chamber.

9. The case according to claim 8, wherein all of said lugs of said case are inside said inner chamber.

10. The case according to claim 1, wherein said case middle includes at least one substantially annular, peripheral wall defining an inner chamber extending around said casing ring arranged to support a timepiece movement and/or a timepiece mechanism, and wherein said case includes lugs outside said case middle, towards the edge of said case, on the opposite side to said inner chamber relative to said case middle.

11. The case according to claim 10, wherein all of said lugs of said case are outside said case middle, towards the edge of said case, on the opposite side to said inner chamber relative to said case middle.

12. The case according to claim 1, wherein the case includes a plurality of said lugs each including, between said case middle and said bezel, a thin elastic, substantially rectilinear median strip, and wherein the directions of all of said thin, elastic, substantially rectilinear strips have a same inclination relative to a same central reference axis.

13. The case according to claim 12, wherein all of said thin, elastic, substantially rectilinear median strips are arranged on a same surface of revolution about said same central reference axis.

14. The case according to claim 13, wherein said surface of revolution is a cone.

15. The case according to claim 13, wherein said surface of revolution is a cylinder.

16. The case according to claim 12, wherein all of said thin, elastic, substantially rectilinear median strips are arranged in a same plane or parallel to a same plane.

17. The case according to claim 1, wherein said case middle comprises, around a substantially annular, peripheral wall defining an inner chamber extending around said casing ring, and around all of said lugs comprised in said case, a resonator ring placed on said case middle or forming a lip of said case middle, said resonator ring being distant at all points from said bezel and from said lugs, and forming with said peripheral wall an outer radiating cavity.

18. The case according to claim 17, wherein said resonator ring is of smaller thickness than that of each said lug, and is made of an alloy of gold and/or of platinum and/or of titanium.

19. The case according to claim 1, wherein said case middle includes at least one substantially annular, peripheral wall defining an inner chamber extending around said casing ring, and wherein said case includes, at a distance from said median support surface for said casing ring on said case middle, at least a first substantially ring-shaped silent-block gasket arranged to limit the transfer of vibrations between an operating musical movement or striking work and the external parts of said case and to decrease unwanted noise without hampering the vibration of each said gong.

20. The case according to claim 1, wherein said case middle comprises at least one substantially annular, peripheral wall defining an inner chamber extending around said casing ring, and wherein said case includes, on said median support surface for said casing ring on said case middle, and between said casing ring and said case middle, at least a second substantially ring-shaped silent-block gasket arranged to limit the transfer of vibrations between an operating musical movement or striking work and the external parts of said case and to decrease unwanted noise without hampering the vibration of each said gong.

21. The case according to claim 1, wherein said case comprises at least one gong fixed to said cover assembly or to a said lug.

22. The case according to claim 1, wherein said case middle is made in one piece with at least one said gong.

23. The case according to claim 1, wherein at least one said gong is added and secured to said case middle.

24. The case according to claim 1, wherein said case middle is made of gold and/or platinum and/or titanium alloy.

25. A musical watch comprising:

a striking mechanism and/or an alarm mechanism and/or a music box mechanism and comprising the case according to claim 1.

* * * * *